United States Patent [19]

Kurokawa et al.

[11] 4,219,070

[45] Aug. 26, 1980

[54] APPARATUS FOR WITHDRAWING GAS FROM HEAT EXCHANGER HAVING EXCHANGER TUBES AND METHOD OF WITHDRAWING GAS BY THE APPARATUS

[75] Inventors: Masahiro Kurokawa, Nara; Noriyuki Oda; Nobuji Shibamoto, both of Osaka, all of Japan

[73] Assignee: Hitachi Shipbuilding & Engineering Company, Ltd., Osaka, Japan

[21] Appl. No.: 946,150

[22] Filed: Sep. 27, 1978

[30] Foreign Application Priority Data

Oct. 5, 1977 [JP] Japan ..... 52-120185

[51] Int. Cl.[2] ..... F28D 15/00

[52] U.S. Cl. ..... 165/11 R; 29/157.3 R; 165/105; 165/DIG. 24

[58] Field of Search ..... 165/105, 11, DIG. 24; 29/157.3 R

[56] References Cited

U.S. PATENT DOCUMENTS 1,873,876 8/1932 Downs ..... 165/105 X

FOREIGN PATENT DOCUMENTS 499293 3/1951 Belgium ..... 165/105

531364 8/1955 Italy ..... 165/105

*Primary Examiner*—Albert W. Davis

*Attorney, Agent, or Firm*—Whittemore, Hulbert & Belknap

[57] ABSTRACT

An apparatus for removing non-condensable gas accumulated in the exchanger tubes of a heat exchanger. A vertically elongated tank having retained in its lower portion a liquefied working medium for the exchanger tubes is provided beside the heat exchanger. The tank communicates as its lower portion with the lower ends of the tubes and at its upper portion with the upper ends of the tubes by lines each provided with a valve. A gas release pipe extends downward from outside into the upper portion of the tank through the tank wall. A working medium condensing cooling tube is provided in the upper portion of the tank. The interior of the tank is partitioned into a condensing tank and a tank main body positioned therebelow and having an upper portion communicating with the upper portion of the condensing tank and a lower portion communicating with the lower portion of the condensing tank. The non-condensable gas is withdrawn from the exchanger tubes in portions of progressively increasing pressure and led into the tank, and the gas is released from the tank to the atmosphere through the release pipe after the gas has been withdrawn from all the tubes.

10 Claims, 4 Drawing Figures

APPARATUS FOR WITHDRAWING GAS FROM HEAT EXCHANGER HAVING EXCHANGER TUBES AND METHOD OF WITHDRAWING GAS BY THE APPARATUS

The present invention relates to a heat exchanger having exchanger tubes, and more particularly to an apparatus for removing from such a heat exchanger the non-condensable gas formed therein when the exchanger is used for a prolonged period of time. The invention also relates to a method of removing the gas with use of the apparatus.

Heat exchangers incorporating exchanger tubes are known as disclosed in U.S. Pat. No. 1,725,906. Heat exchangers of this type include two divided heat exchanging chambers disposed one above the other for passing therethrough a heating fluid and the fluid to be heated respectively and a multiplicity of exchanger tubes extending through both the chambers and arranged in rows and in stages. The tubes are filled with a working medium, which continuously undergoes evaporation and condensation in repetition, whereby the heat of the heating fluid through one chamber is transferred to the fluid passed through the other chamber for heating.

When the main body of the exchanger tube is made for example of carbon steel and the working medium, volatile liquid, enclosed in the tube is water, the tube main body chemically reacts with the enclosed medium, forming a very small amount of non-condensable gas such as hydrogen gas. Consequently if the exchanger is operated for a prolonged period of time, a large amount of noncondensable gas will be accumulated within the exchanger tubes, resulting in objections such as a greatly reduced heat transfer efficiency. Thus there arises the necessity of withdrawing the non-condensable gas from the tubes periodically.

The main object of this invention is to provide an apparatus for withdrawing non-condensable gas from a heat exchanger even during the operation of the exchanger without interrupting the operation.

Another object of this invention is to provide an apparatus by which the non-condensable gas can be withdrawn with use of the gas pressure available during the operation of the exchanger without employing a power source such as a vacuum pump.

Another object of this invention is to provide an apparatus by which when the non-condensable gas is withdrawn from the exchanger tubes and released to the atmosphere, the release of the gas can be completed promptly while minimizing the dissipation of heat and the escape of the working medium along with the gas.

To fulfil the main object, the present invention provides an apparatus comprising a vertically elongated tank disposed beside a heat exchanger and having retained in its lower portion a liquefied working medium, lines maintaining the lower portion of the tank in communication with the lower ends of the exchanger tubes of the heat exchanger and maintaining the upper portion of the tank in communication with the upper ends of the exchanger tubes, each of the lines being provided with a valve, and a gas release pipe provided with a valve and connected to the upper portion of the tank.

The present invention further provides an apparatus of the type described in which the tank includes a condensing portion comprising a cooling tube for condensing the working medium flowing into the tank in a vaporized state. The condensing portion functions to reduce the internal pressure of the tank, permitting vaporized working medium to flow out from the exchanger tubes toward the tank, while entraining the non-condensable gas therein, and allowing the tubes to be replenished with the liquefied medium from the tank. The non-condensable gas entrained in the vaporized working medium is introduced into and retained in the tank by the action of the circulating flow thus formed.

The present invention further provides an apparatus of the type described in which the tank is divided into a condensing tank having the condensing portion and a tank main body including an upper portion in communication with the upper portion of the condensing tank and a lower portion in communication with the lower portion of the condensing tank, the condensing tank thus being adapted to collect therein the non-condensable gas before the gas is released from the gas release pipe, so that the collected gas can be released to the atmosphere rapidly while inhibiting the dissipation of heat and the escape of the working medium.

Another object of this invention is to provide a method of withdrawing non-condensable gas from a heat exchanger with use of the forgoing apparatus by withdrawing the non-condensable gas from a group of exchanger tubes of low internal pressure, then from another group of exchanger tubes of higher internal pressure and so on and introducing the gas into the tank, and releasing the collected gas from the tank to the atmosphere rapidly at one time after the gas has been withdrawn from all the tubes, by utilizing the highest internal pressure of exchanger tubes, so that the gas can be removed from the exchanger while minimizing the dissipation of heat and escape of vaporized working medium.

Various other features and advantages of this invention will become apparent from the description of a preferred embodiment and modifications thereof given below with reference to the accompanying drawings, in which.

Figure 1:
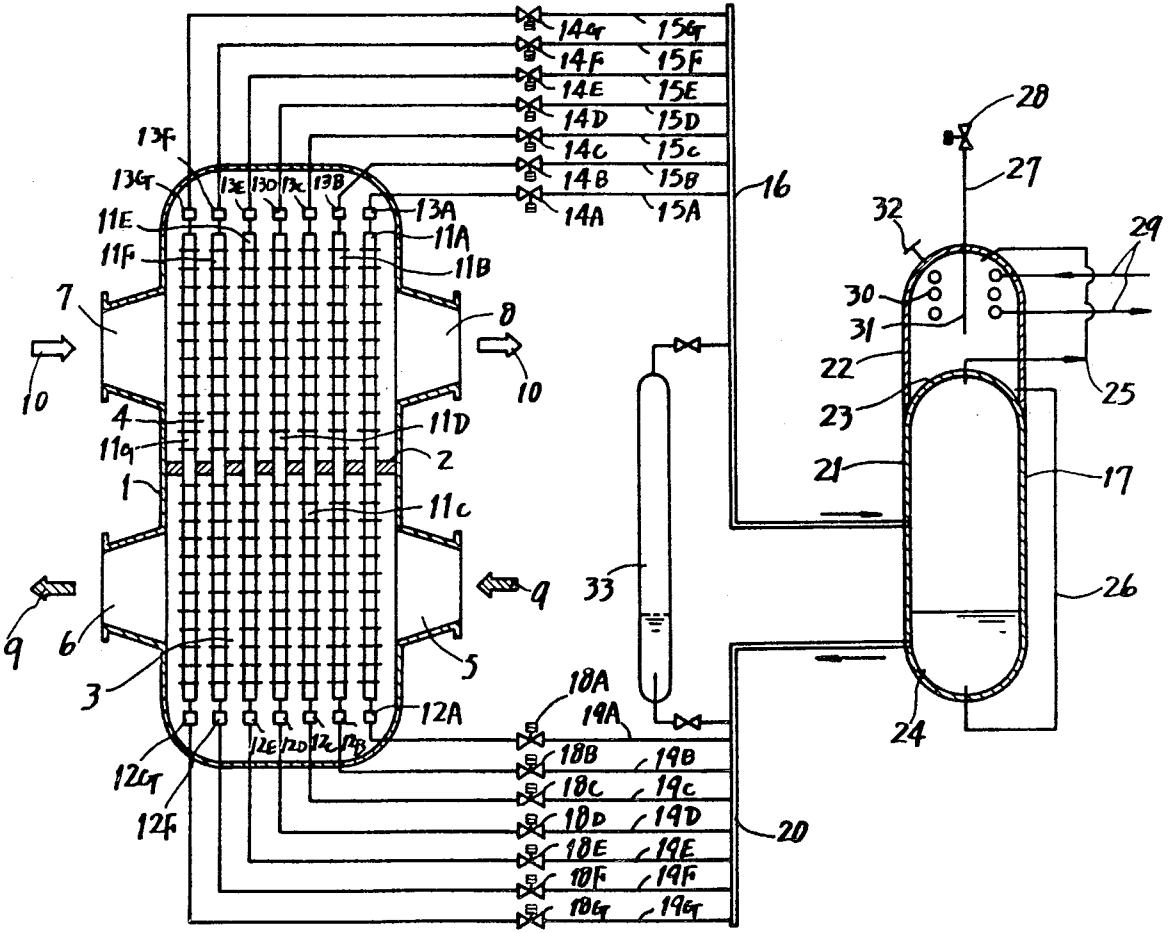
FIG. 1 is a flow chart schematically showing the construction of the preferred embodiment of the apparatus of the present invention.

With reference to FIG. 1, a closed hollow cylindrical main body 1 includes an intermediate partition wall 2 for dividing the interior of the main body 1 into a lower heat exchanging chamber 3 and an upper heat exchanging chamber 4. The lower heat exchanging chamber 3 is provided on its opposite sides with a heating fluid inlet 5 and a heating fluid outlet 6 respectively, while the upper heat exchanging chamber 4 is similarly provided with an inlet 7 for the fluid 10 to be heated and an outlet 8 for the fluid 10. Heating fluid 9 has their inlet 5 and outlet 6 disposed in reverse relation to the corresponding parts provided for the fluid 10 to be heated so that the two fluids flow in directions opposite to each other as indicated by the arrows. Exchanger tubes 11 extend vertically through the partition wall 2 across both the heat exchanging chambers 3 and 4 and are arranged in a plurality of rows and also in a plurality of stages. Thus a number of tubes arranged in a direction at right angles to the flows of the fluids 9 and 10 form a group, and such groups are arranged in the plurality of stages in the flow direction. For the simplification of illustration, FIG. 1 shows seven stages which are designated at 11A, 11B, 11C, 11D, 11E, 11F, 11G as arranged from the heating fluid inlet side toward the outlet 6. Each of the exchanger tubes 11 comprises a tube main body in the form of a pipe made for example of carbon steel and a large number of fins attached to the outer periphery of the main body and arranged at suitable spacing axially thereof. The tubes in each of the stages 11A to 11G are connected, at their lower ends, to the corresponding one of headers 12A, 12B, 12C, 12D, 12E, 12F, 12G for supplying a working medium and are also connected, at their upper ends, to the corresponding one of headers 13A, 13B, 13C, 13D, 13E, 13F, 13G for collecting non-condensable gas. The gas collecting headers 13A to 13G communicate with a gas withdrawing main line 16 by way of gas withdrawing lines 15A, 15B, 15C, 15D, 15E, 15F, 15G having valves 14A, 14B, 14C, 14D, 14E, 14F, 14G respectively. The main withdrawing line 16 is in communication with the upper portion of a vertically elongated tank 17 provided beside the main body 1. The supply headers 12A to 12G communicate with a working medium supplying main line 20 by way of working medium supplying lines 19A, 19B, 19C, 19D, 19E, 19F, 19G having valves 18A, 18B, 18C, 18D, 18E, 18F, 18G respectively. The main supply line 20 is in communication with the lower portion of the tank 17.

The tank 17 of the present embodiment comprises a tank main body 21 and a condensing tank 22 positioned above the main body 21 and separated therefrom by a mirror plate 23. The lower portion of the tank main body 21 accommodates the working medium in a liquefied state as indicated at 24. The main supply line 20 is in communication with the tank main body 21 at a position below the liquid level of the working medium 24. On the other hand, the main withdrawing line 16 communicates with the space in the tank main body 21 at a position above the liquid level. The upper end of the tank main body 21 communicates with the upper portion of the condensing tank 22 via a connecting line 25, while the lower end of the condensing tank 22 communicates with the lower portion of the tank main body 21 by way of a working medium recovering line 26. The condensing tank 22 is provided with a gas release pipe 27 extending through its top wall and having a stop valve 28 capable of preventing a return flow. The condensing tank 22 houses in its upper portion a coiled cooling tube 30 connected to cooling lines 29. The gas release pipe 27 has an extension 31 extending downward from the top wall of the condensing tank through the coil of the cooling tube 30 centrally thereof. The extension 31 has an open lower end in the lower portion of the tank 22. The condensing tank 22 has in its upper portion an inlet 32 for the working medium 24. A liquid level indicator 33 disposed on one side of the tank 17 is provided between the withdrawing main line 16 and the supply main line 20.

The foregoing embodiment will operate in the following manner. During operation, the fluids 9 and 10 flow through the heat exchanging chamber 3 and 4 respectively, permitting repeated evaporation and condensation of the working medium 24 within the exchanger tubes, whereby heat exchange is effected as desired. Stated more specifically, the heating fluid 9 flowing into the lower chamber 3 is subjected to heat exchange with the tubes 11, thus giving heat to the working medium within the tubes 11 before flowing out from the lower chamber 3 and thereby being cooled in itself. On the other hand, the fluid 10 to be heated flows into the upper heat exchanging chamber 4 in a direction opposite to the direction of flow of the heating fluid 9 and is subjected to heat exchange with the tubes 11, thus extracting heat from the working medium in the tubes 11 before egressing from the upper chamber 4 and thereby being heated in itself. In the meantime, the working medium undergoes evaporation and condensation repeatedly within the closed tubes 11. It therefore follows that heat exchange takes place between tubes 11 in stages 11A, 11B, . . . closer to the inlet 5 for the heating fluid 9 and the high-temperature portions of the heating fluid 9 and of the fluid 10 to be heated, and also between tubes 11 in stages 11G, 11F, . . . closer to the outlet 6 of the heating fluid 9 and the low-temperature portions of the heating fluid 9 and of the fluid 10. Consequently the working medium within the tubes of the stage 11A closest to the inlet 5 of all the stages 11A to 11G operates at the highest temperature and therefore has the highest pressure. The pressure of the medium progressively decreases from stage to stage toward the outlet 6. Thus the working medium within the tubes in the stage 11G closest to the outlet 6 has the lowest pressure.

In order to withdraw accumulated non-condensable gas from the exchanger tubes 11, the interior of the tank 17 must have a relatively high degree of vacuum before the withdrawal so that the non-condensable gas can be led into the tank 17 even from the tubes in the stage 11G of low pressure. For this purpose, there arises the necessity of completely removing air from the tank 17, namely from the tank main body 21 and the condensing tank 22. This can be accomplished by the following procedure. First, the valves 14A, 18A and 28 are opened, whereupon the vaporized working medium of the highest pressure flows into the condensing tank 22 by way of the withdrawing line 15A, main withdrawing line 16, tank main body 21 and connecting line 25. The air within the tank main body 21 is collected in the condensing tank 22 by this flow and released to the atmosphere through the gas release pipe 27 along with the portion of the working medium which has not been condensed by the cooling tube 30. With the extension 31 of the gas release pipe 27 opened in the lower portion of the condensing tank 22, the air will in no way remain in the bottom of the tank 22 without escaping as above. On completion of the removal of air, the valves 14A, 18A and 28 are closed, with the result that the spaces within the tank main body 21 and condensing tank 22 are filled only with the vaporized working medium, which is thereafter cooled by the cooling tube 30, consequently producing a relatively high degree of vacuum within the tank 21 and the tank main body 22. In this state, non-condensable gas will be withdrawn first from the tubes 11 in the stage 11G having the lowest pressure. The valves 14G and 18G are opened, whereupon the non-condensable gas within the tubes of stage 11G and collecting header 13G flows into the tank main body 21 in a vacuum through the withdrawing line 15G and main withdrawing line 16. At the same time, the vapor of the working medium fills up the collecting header 13G. The valves 14G and 18G are closed. Subsequently the valves 14F and 18F are opened, permitting the non-condensable gas of higher pressure to flow out from the heat exchanger into the tank main body 21 of lower pressure. Similar procedure is thereafter repeated in succession. Finally gas is withdrawn from the tubes of stage 11A of the highest pressure, and the valves 14A and 18A are thereafter closed. The non-condensable gas flowing into the tank main body 21 during the above procedure flows through the connecting line 25 into the condensing tank 22 which is at lower pressure due to the provision of the condensing means. The vaporized working medium is condensed by the cooling tube 30, flows through the recovering line 26 into the lower portion of the tank main body 22 and joins the liquefied working medium therein. Consequently, the internal pressure of the condensing tank 22 reduces in corresponding relation to the volume of vaporized working medium thus condensed within the tank 22. The interior of the tank 22 is therefore maintained at lower pressure than in the tank main body 21. On the other hand, the non-condensable gas is retained in the condensing tank 22. The arrangement in which the tank 22 is positioned above the tank main body 21 according to the present embodiment assists the non-condensable gas in flowing from the tank main body 21 to the tank 22 since the gas is lower than the vaporized working medium in specific gravity. In this way the non-condensable gas is progressively effectively introduced into the condensing tank and retained therein. When the valve 28 is then opened, the non-condensable gas escapes from the tank 22 to the atmosphere via the gas release pipe 27 and valve 28 since the internal pressure of the tank main body 21 and of the tank 22 is higher than the atmospheric pressure. If the valve 28 is opened with the valves 14A and 18A held opened without being closed as above, a stream of vaporized working medium will be formed which flows from the tube groups 11A of the highest pressure through the gas release pipe 27 to the atmosphere, whereby the non-condensable gas can be forced out as entrained in the stream. After the gas has been completely released from the condensing tank, the valve 28 is closed. At this time the valves 14A and 18A are closed as the case may be. When the condensing tank 22 is separate from the tank main body 21 as described above, the release of non-condensable gas can be completed promptly while minimizing the amount of vaporized working medium to be released together with the gas. After the valve 28 is closed, the vapor of working medium and the liquefied working medium (in the tank lower portion) alone are present within the condensing tank 22 and the tank main body 21, namely within the tank 17. Accordingly a predominant portion of the vaporized working medium within the tank 17 is condensed by the heat exchange between the tank 17 and the outside and also by being heated with the cooling tube 30. Thus the interior of the tank 17 is maintained at a high degree of vacuum equal to the saturated vapor pressure of the working medium at room temperature. Since the valve 28 is serviceable also as a check valve, air will not flow into the tank 17 even if it is opened when at a lower pressure than the atmospheric pressure. This ensures that the non-condensable gas will be forced out by the pressure of vaporized working medium which is higher than the atmospheric pressure. To compensate for the small amount of working medium which has escaped to the atmosphere along with the non-condensable gas, the tank 17 will be replenished with fresh medium through the inlet 32 when so desired.

The method of operating the present apparatus described above is not limitative. For example, non-condensable gas may be withdrawn from the exchanger tubes of a particular stage alone and then released from the condensing tank 22 to the atmosphere instead of being released together with the gas from the other stages. Alternatively, non-condensable gas may be withdrawn from the tubes of some of the stages 11A to 11G except for specified stages and then released to the atmosphere. In the case where air has ingressed into the tank 17 from outside during the replenishment of the working medium or while the heat exchanger is held out of operation for a long period of time, the air can be withdrawn from the tank 17 by utilizing the pressure of tube stage 11A at the highest pressure level in the manner already described.

It is preferable to use automatically operable valves, such as electromagnetic valves, for the valves 14A to 14G and 18A to 18G.

Figure 2:
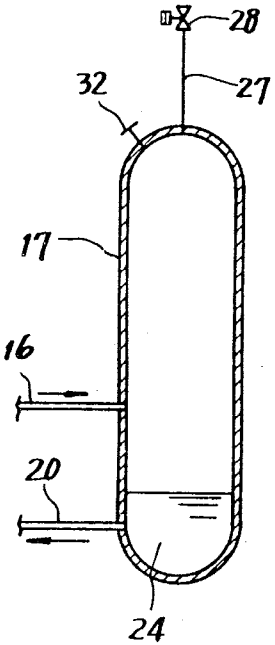
FIG. 2 is a view in vertical section schematically showing a modified tank of the simplest and basic construction.

The present invention is not limited to the preferred embodiment described above. FIG. 2 shows the simplest and basic example of the tank 17. The tank 17 shown in FIG. 2 is in the form of a single tank structure accommodating liquefied working medium 24 in its lower portion and merely provided at its upper portion with a gas release pipe 24 having a valve 28 at the upper end thereof and an inlet 32 for the working medium 24. With use of this structure, air or non-condensable gas is removable from the tank substantially in the same manner as already described during the operation of the heat exchanger without necessity of using a particular power source such as a vacuum pump. However, with this construction in which no condensing means is provided within the tank 17, the vaporized working medium present in the tank 17 and the vaporized working medium introduced into the tank 17 along with non-condensable gas must be condensed by the heat exchange between the tank 17 and the outside, namely by spontaneous cooling, after air has been driven out. Accordingly the tank requires some time before it is ready for the withdrawal of non-condensable gas from the exchanger tubes. Furthermore the release of the gas from the tank 17 takes a longer time and involves dissipation of an increased amount of heat.

Figure 3:
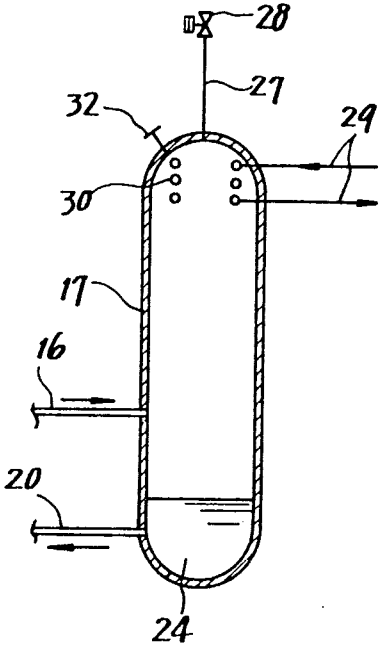
FIG. 3 is a view in vertical section schematically showing an improved tank comprising the tank of FIG. 2 and condensing cooling tube provided therein.

The construction of tank 17 shown in FIG. 3 is free of such drawbacks since a cooling tube 30 is provided in the upper portion of the tank unlike the tank shown in FIG. 2. However, this tank does not have the advantage of the tank shown in FIG. 1 that the non-condensable gas is collected in the condensing tank 22 separated from the tank main body 21 so that the collected gas can be released to the atmosphere within a short period of time with minimized heat dissipation.

Figure 4:
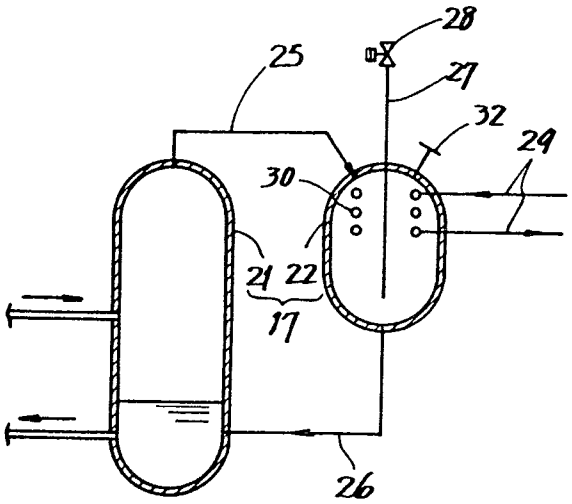
FIG. 4 is a view in vertical section schematically showing a preferred modification of the tank shown in FIG. 1.

FIG. 4 shows a modification equivalent to the construction shown in FIG. 1 and comprising a tank main body 21 and a condensing tank 22 which are entirely separate from each other instead of being partitioned from each other by the mirror plate 23 of FIG. 1. The condensing tank 22 is disposed on one side of the tank main body 21.

What is claimed is:

1. An apparatus for withdrawing non-condensable gas from a heat exchanger divided into an upper heat exchanging chamber and a lower heat exchanging chamber and including a multiplicity of exchanger tubes extending through both the heat exchanging chambers and arranged in a plurality of rows and in a plurality of stages, comprising:

a vertically elongated tank disposed beside the heat exchanger and having retained in its lower portion a liquefied working medium for the exchanger tubes, lines maintaining the working medium retaining portion of the tank in communication with the lower ends of the exchanger tubes and maintaining the interior space of the tank above the retaining portion thereof in communication with the upper ends of the exchanger tubes, each of the lines being provided with a valve, and a gas release pipe provided with a valve and connected to the upper portion of the tank.

2. An apparatus as defined in claim 1 wherein the tank has a condensing portion in its interior.

3. An apparatus as defined in claim 2 wherein the condensing portion comprises a cooling tube connected to a cooling water line.

4. An apparatus as defined in claim 2 wherein the condensing portion is disposed close to the upper end of the tank.

5. An apparatus as defined in claim 2 wherein the tank is divided into a condensing tank having the condensing portion and a tank main body having the retaining portion, the upper portion of the tank main body being in communication with the interior of the condensing tank, the retaining portion of the tank main body being in communication with the lower end of the condensing tank.

6. An apparatus as defined in claim 5 wherein the condensing tank and the tank main body are separate from each other.

7. An apparatus as defined in claim 5 wherein the condensing tank is positioned above the tank main body.

8. An apparatus as defined in claim 5 wherein the gas release pipe has an extension extending downwardly from the wall of the condensing tank and having an opening in the lower portion of the condensing tank.

9. An apparatus as defined in claim 1 wherein the tank is provided with a working fluid inlet.

10. A gas withdrawing method using the apparatus defined in claim 1 and comprising passing a fluid through one of the heat exchanging chambers in a direction opposite to the direction of the flow of another fluid through the other heat exchanging chamber to thereby successively vary the internal pressure of the exchanger tubes from stage to stage along the flow direction, withdrawing the non-condensable gas from the exchanger tubes stage by stage from low-pressure stage to higher-pressure stage and introducing the gas into the tank, and releasing the non-condensable gas from the tank to the atmosphere after the gas has been withdrawn from all the stages.

* * * * *